US007188424B2

(12) United States Patent
Webster et al.

(10) Patent No.: US 7,188,424 B2
(45) Date of Patent: Mar. 13, 2007

(54) CUTTING WHEEL

(75) Inventors: David Webster, San Francisco, CA (US); Hans-Christoph Haenlein, San Jose, CA (US); Thomas Overthun, San Francisco, CA (US); Sven Newman, Menlo Park, CA (US); Sam Palmer, Menlo Park, CA (US); Annetta Papadopoulos, Palo Alto, CA (US); James Yurchenco, Palo Alto, CA (US)

(73) Assignee: Zyliss USA Corp., Irvine, CA (US)

( * ) Notice: Subject to any disclaimer, the term of this patent is extended or adjusted under 35 U.S.C. 154(b) by 622 days.

(21) Appl. No.: 10/674,931

(22) Filed: Sep. 30, 2003

(65) Prior Publication Data

US 2006/0168823 A1 Aug. 3, 2006

(51) Int. Cl.
*B26B 5/00* (2006.01)

(52) U.S. Cl. ..... 30/365; 30/164.95; 30/292; 30/307; 30/319

(58) Field of Classification Search ..... 30/153, 30/319, 307, 164.95, 365, 114, 292, 319 X, 30/307 X, 164.95 X, 292 X; D7/694
See application file for complete search history.

(56) References Cited

U.S. PATENT DOCUMENTS 329,019 A * 10/1885 Cole ..... 30/292
733,511 A * 7/1903 Ridgely ..... 30/292
775,434 A * 11/1904 Williams ..... 30/292
1,983,778 A * 12/1934 Rosenquist ..... 30/292
2,736,092 A * 2/1956 Joyet ..... 30/347
4,020,550 A * 5/1977 Okada ..... 30/292
4,241,504 A * 12/1980 Ceron ..... 30/292
6,438,850 B2 * 8/2002 Young et al. ..... 30/319
6,484,405 B1 * 11/2002 Martelli ..... 30/319
6,643,936 B2 * 11/2003 Carlson et al. ..... 30/319
D519,334 S * 4/2006 Molenaar ..... D7/694
7,134,209 B1 * 11/2006 Molenaar ..... 30/319
2004/0231475 A1 * 11/2004 Cornfield et al. ..... 30/319
2005/0028388 A1 * 2/2005 Liu ..... 30/319

FOREIGN PATENT DOCUMENTS

BE 1013992 * 1/2003

* cited by examiner

*Primary Examiner*—Jason Prone
(74) *Attorney, Agent, or Firm*—Snell & Wilmer LLP

(57) ABSTRACT

A cutting device in accordance with the present invention is deal for use in cutting pizza and other "flat-bread" like cuisine. For example, in accordance with various embodiments, a cutting device is provided which exhibits improved functionality and ease of use through the use of handle which directs the cutting force from a user in the most efficient manner to carryout the task of cutting, for example, pizza. Moreover, the handle may provide improved protection of the user from accidental injury during use as well as be suitably configured to retract in a manner which facilitates removal of the cutting blade.

19 Claims, 9 Drawing Sheets

(a)

(b)

CUTTING WHEEL

CROSS-REFERENCE TO RELATED APPLICATIONS

This application claims the benefit of the filing date of United States Design patent application Ser. No. 29/180,502 entitled "CUTTING WHEEL," filed Apr. 24, 2003.

FIELD OF THE INVENTION

This invention generally relates to cutting devices, and more particularly, to a cutting device ideally configured for cutting pizza and other "flat-bread" like items into individual slices.

BACKGROUND OF THE INVENTION

Various devices for the cutting and slicing of many different items have been both desirable and available for centuries. For example, as far back as one can search in recorded history, blade-type knives have been used in the most important and basic of human activities, from the hunting, to the dressing and slicing of food into portions suitable for consumption. As such, improvements to cutting and slicing devices have continuously been sought. For example, the various blades have evolved over the ages into finely crafted, precision instruments constructed from newer, stronger and sharper materials from high strength steel alloys to titanium.

However, notwithstanding the developments in cutting and slicing technology, devices known heretofore are undesirable in many respects. That is, while blades become sharper and stronger, allowing them to retain sharp cutting edges for longer and longer periods of time, desirable attributes continue to remain unrealized.

For example, many suffer from being ergonomically difficult to use. Exemplary of such short-comings, many cutting devices have long handles positioned well away from the portion of the blade edge most suited for cutting, and thus create increased tension and stress in the user's wrist.

Additionally, in efforts to increase the safety of cutting devices, various guards and shields have been employed to protect the user and others from the sharp edges of the blades. However, many of these guards trap debris within, making subsequent cleaning of the blades difficult.

Relatedly, while many of these improved devices are comprised of strong materials and posses the capability of slicing even the toughest substances, they require a gentle touch during cleaning, or they will lose their sharpened edges. For example, many of such blades are not "dishwasher" safe, and the simple act of placing in them in a dishwasher may ruin, or at least greatly diminish, sought after benefits such as the long time retention of a sharp edge.

For example, one currently known device which suffers from the foregoing is the pizza cutter. Briefly, as illustrated in FIG. 1, typical pizza cutters use a circular blade 10 comprised of stainless steel or other similar alloys or materials. The circular blade is typically rotatably mounted on axle 12 connected by "forks" 14 to one end of an elongated handle 16. The handle 16 is held while moving the blade 10 across pizza. While the blade 10 is moved, it tends to rotate about its axle 12 as it rolls across the pizza. However, these cutters suffer from many of the foregoing drawbacks as they are often bulky and awkward, the cutting pressure from the user is difficult, if not impossible, to direct over the cutting center of the blade, the forks may make cleaning difficult by trapping debris, and the exposed blade may become dulled when stored or run through dishwashers.

Thus, it is apparent that particular examples of the drawbacks of currently known slicing devices are numerous. However, suffice it to say, there is a long-felt need for cutting devices which improve upon the ergonomics of the device to the user, which improve the safety of the device, yet which still facilitate the cleaning of the blade. As will be described hereinbelow, the present invention addresses such long-felt needs in all areas of slicing, and as will become apparent, will demonstrate particular utility in the areas of slicing pizza and other "flat-bread" like cuisine.

SUMMARY OF THE INVENTION

While the way in which the present invention addresses the disadvantages of the prior art will be discussed in greater detail below, in general, the present invention provides for a cutting device which offers significant advantages to the user of the device which the prior art does not address.

For example, in accordance with various embodiments of the present invention, a cutting device is provided which exhibits improved functionality and ease of use through the use of a handle which directs the cutting force from a user in the most efficient manner to carryout the task of cutting items such as, for example, pizza. Moreover, in some instances, the handle provides additional protection to the user from accidental injury during use because a reduction in the amount of cutting surface of the blade to an exposed area.

In accordance with various further aspects of the present invention, the cutting device is suitably configured such that the actual cutting blade can be easily cleaned (or otherwise maintained). For example, in accordance with various aspects of the present invention, the cutting blade is removable. Further yet, in various embodiments, the handle is suitably configured to retract in a manner which facilitates removal of the cutting blade.

BRIEF DESCRIPTION OF THE DRAWINGS

The subject matter of the present invention is particularly pointed out and distinctly claimed in the concluding portion of the specification. A more complete understanding of the present invention, however, may best be obtained by referring to the detailed description and claims in connection with the drawing figures, wherein:

DETAILED DESCRIPTION

The following description is of exemplary embodiment of the invention only, and is not intended to limit the scope, applicability or configuration of the invention in any way. Rather, the following description is intended to provide a convenient illustration for implementing various embodiments of the invention. As will become apparent, various changes may be made in the function and arrangement of the elements described in these embodiments without departing from the scope of the invention as set forth in the appended claims. For example, in the context of the present invention, the apparatus hereof finds particular use in connection with the cutting of pizza into individual slices. However, generally speaking, it should be apparent that devices in accordance with the present invention should not be construed as limited to pizza cutting devices. Rather, the devices should be understood to have the ability to cut many materials now known or as yet unknown (and not necessarily just those associated with culinary applications). As such while the cutting of pizza is used for exemplary purposes herein, the scope of the present invention should not be so limited.

That said, the present invention is described herein with respect to cutting devices having at least one cutting wheel and may be used when cutting flat-bread style cuisine such as pizzas. For example, with reference to an exemplary embodiment of the present invention illustrated in FIG. 2, pizza cutter 100 generally comprises a handle 110 and a blade 200.

Figures 3, 4:
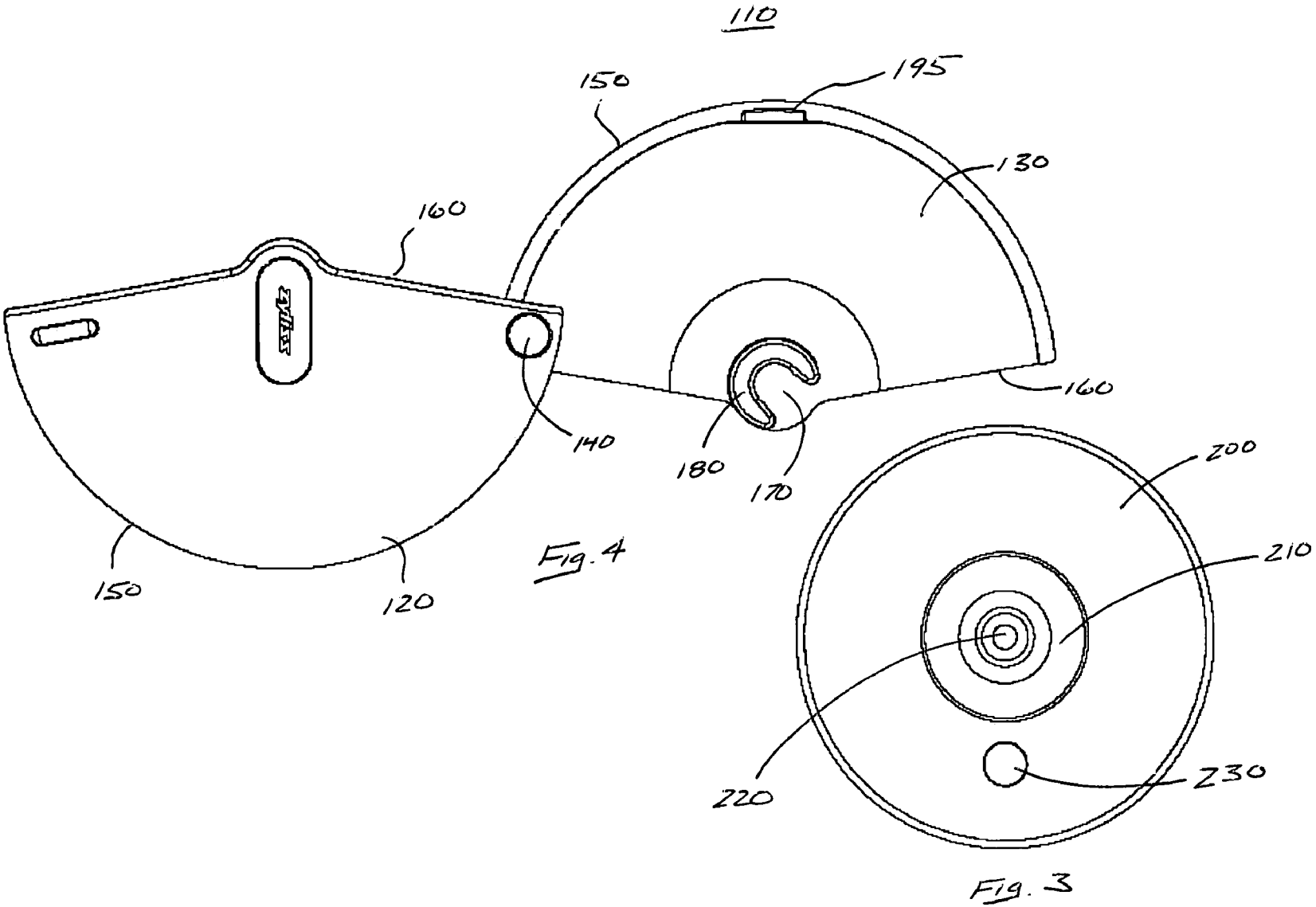
FIG. 3 is a side view of an exemplary blade in accordance with various aspects of the present invention.
FIG. 4 is a side view of an exemplary assembled and open pizza cutter housing in accordance with various aspects of the present invention.

In this exemplary embodiment, blade 200 comprises a conventional stainless steel material, though any number of suitably rigid material capable of generally maintaining a sharp edge for slicing and cutting, whether now known or as yet unknown, may fall within the ambit of the present invention. With reference to FIG. 3, blade 200 is generally circular in shape, and though may be provided in any number of sizes, in this non-limiting embodiment, blade 200 has a diameter of about 10 cm.

In accordance with various embodiments of the present invention, blade 200 further comprises a blade axle 210. In this embodiment, blade axle 210 is a molded plastic axle (though, similar to the material selection of blade 200, numerous known or unknown materials may be used) for facilitating the rotation of blade 200 in housing 110. For example, with continuing reference to the embodiment described now and illustrated in FIG. 3, axle 210 has two opposing ends which, as described further below, engage axle bearing surfaces 175 (not shown in FIG. 3) in housing 110, and allow blade 200 to rotate with respect to housing 110.

With particular reference to axle 210 of the presently described embodiment, each opposing end (though not shown in FIG. 3, the opposing end of axle 210 is generally similar to the shown end) of axle 210 has an axle lock (or "detent") 220 which engages the aforementioned axle bearing surfaces. As will described further herein, benefits achieved by providing an ability for axle 210 to lock into housing 100 include the prevention of blade's 200 removal from housing 100 until desired and/or increased stability vis-à-vis less "rattle" or motion in axial or radial directions.

Further still, with continued reference to FIG. 3, blade 200 may further comprise features which help to facilitate its removal, storage, various aesthetical qualities and other characteristics. For example, in the presently described embodiment, blade 200 further comprises a removal facilitator 230 which can be grasped and used to pull blade 200 from housing 110. Removal facilitator 230 generally comprises any portion of blade 200 which can be serve such a purpose, however, in the presently described embodiment facilitator 230 comprises a cavity through blade 200. As such, while cavity 230 can be grasped for removal, other benefits, such as the ability to hang pizza cutter 100 by removal facilitator 230 are realized.

In accordance now with the presently described embodiment of the present invention, handle 110 comprises plastic, though any suitably rigid material capable of supporting blade 200 may be substituted in accordance with the present invention. For example, any number of polymeric materials, metals, or other elements may fall within the scope of the present invention.

With reference now to FIG. 4, in accordance with an exemplary embodiment of the present invention, handle 110 comprises a first half 120 and a second half 130 pivotally connected to one another by a housing axle 140. Preferably, as will be defined further below, housing axle 140 is located on housing 110 proximate to a corner defined by an intersection point between a gripping border 150 and a blade exposing border 160. Stated otherwise, first and second halves preferably pivot at a corner.

Figure 1:
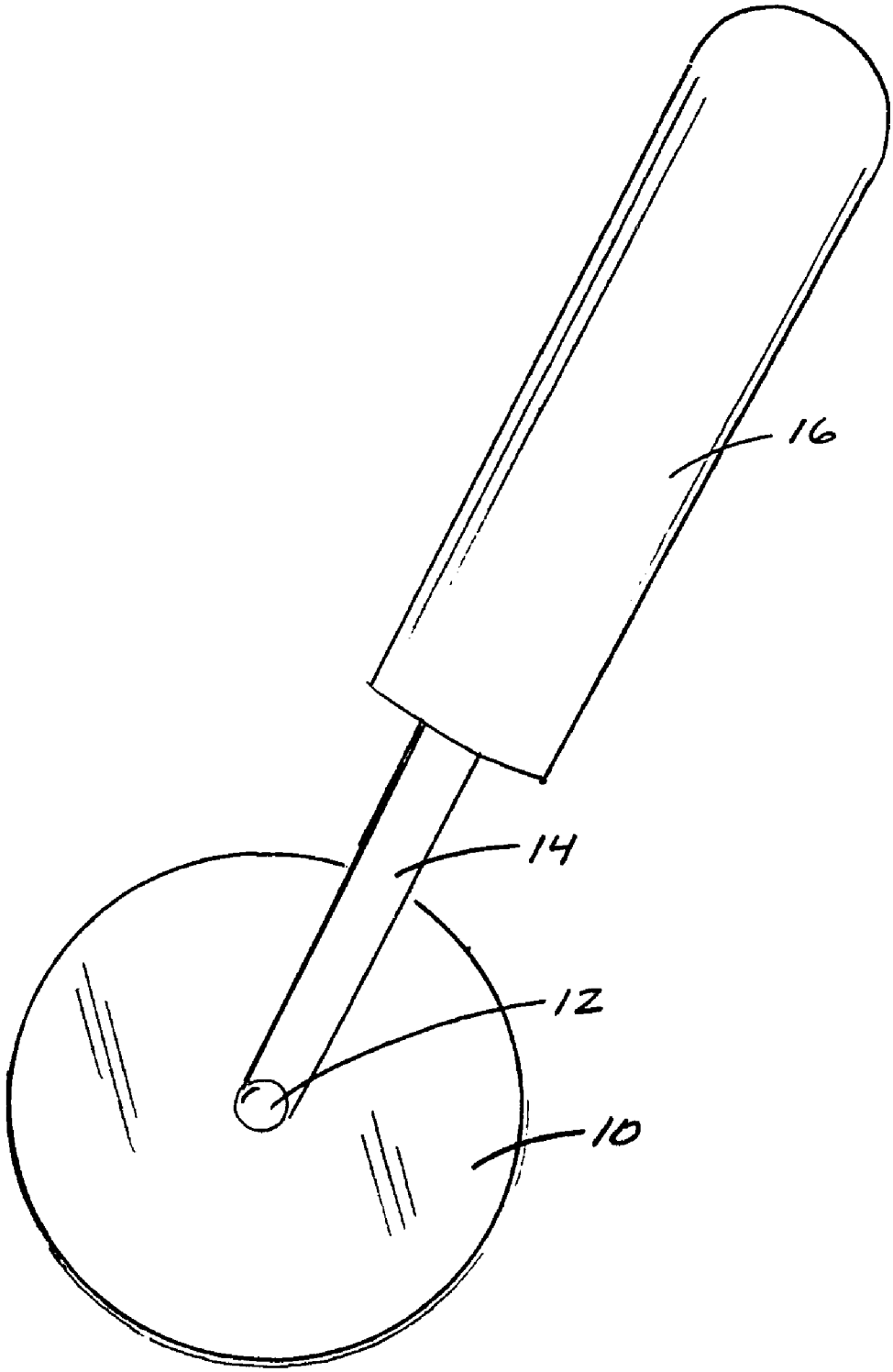
FIG. 1 (PRIOR ART)
FIG. 1 is a typical prior art pizza cutting device.
Figure 2:
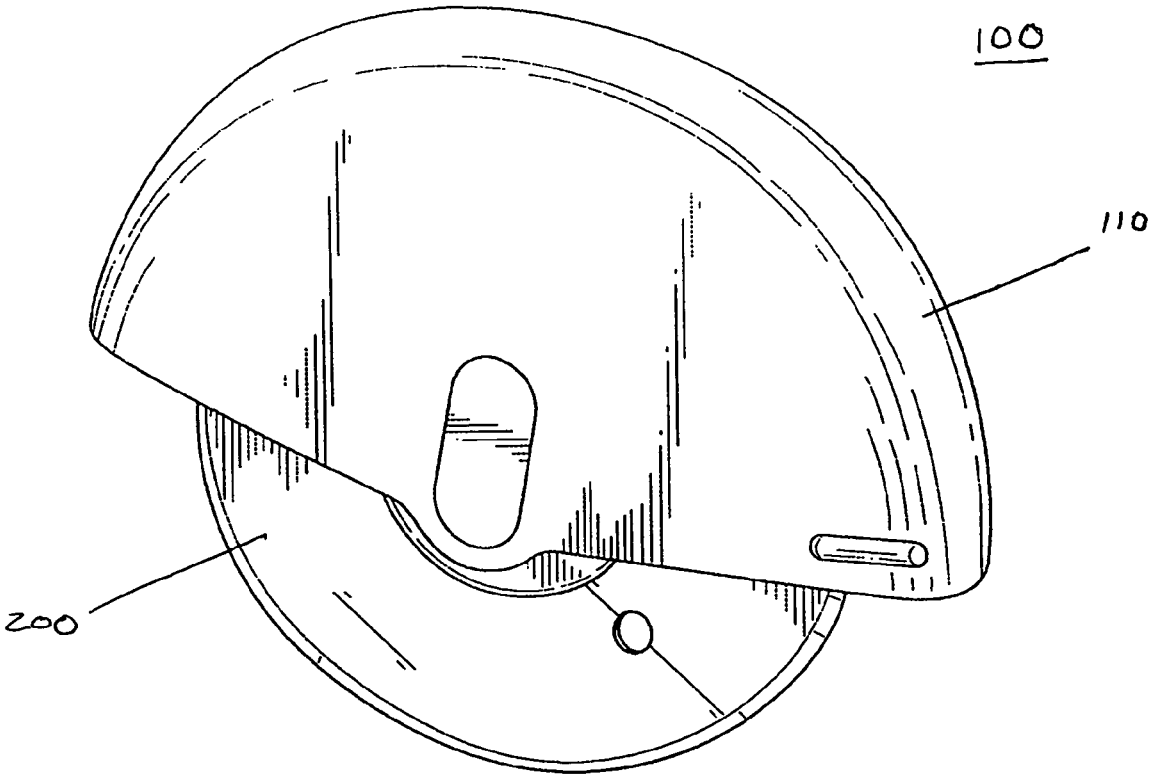
FIG. 2 is a perspective view of an exemplary pizza cutter in accordance with various aspects of the present invention.

As will be described below, first and second halves 120, 130 preferably have an open position and a closed position. In accordance with various embodiments of the present invention, pizza cutter 100 is used when in the closed position. An embodiment of the present invention in a closed position is illustrated in FIG. 2. Inapposite, an embodiment of the present invention in an open position is illustrated in FIG. 4. As will be described below, an open position thus facilitates removal of blade 200, for inter alia, cleaning, storage, etc.

First and second halves 120, 130 generally may be comprised in any number of shapes and sizes and are generally mirror images of one another, though differences between the two halves 120, 130, which facilitate benefits of the present invention, will be described below. That said, generally, halves 120, 130 are at least slightly bigger than blade 200 so that blade 200 may fit at least partially within housing 110 (assembled halves 120, 130). Additionally, while numerous shapes may be used and still fall within the scope of the present invention, certain shapes provide the ability to shield portions of blade 200 from user, as well as assist to concentrate force imparted from a user of cutter 100 through a center of blade 200, increasing the efficacy of cutting.

Figure 5:
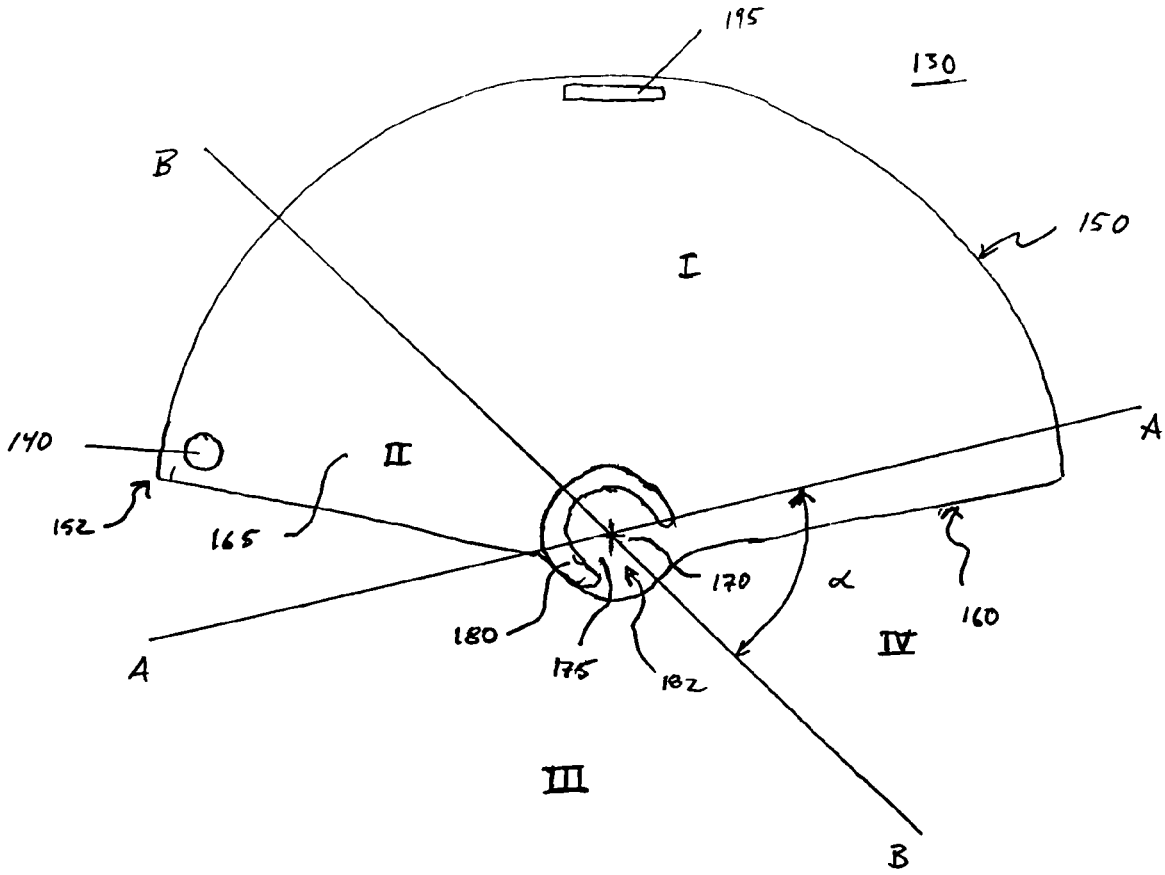
FIG. 5 is a side view of an exemplary insertion half of a pizza cutter housing in accordance with various aspects of the present invention.
Figure 6:
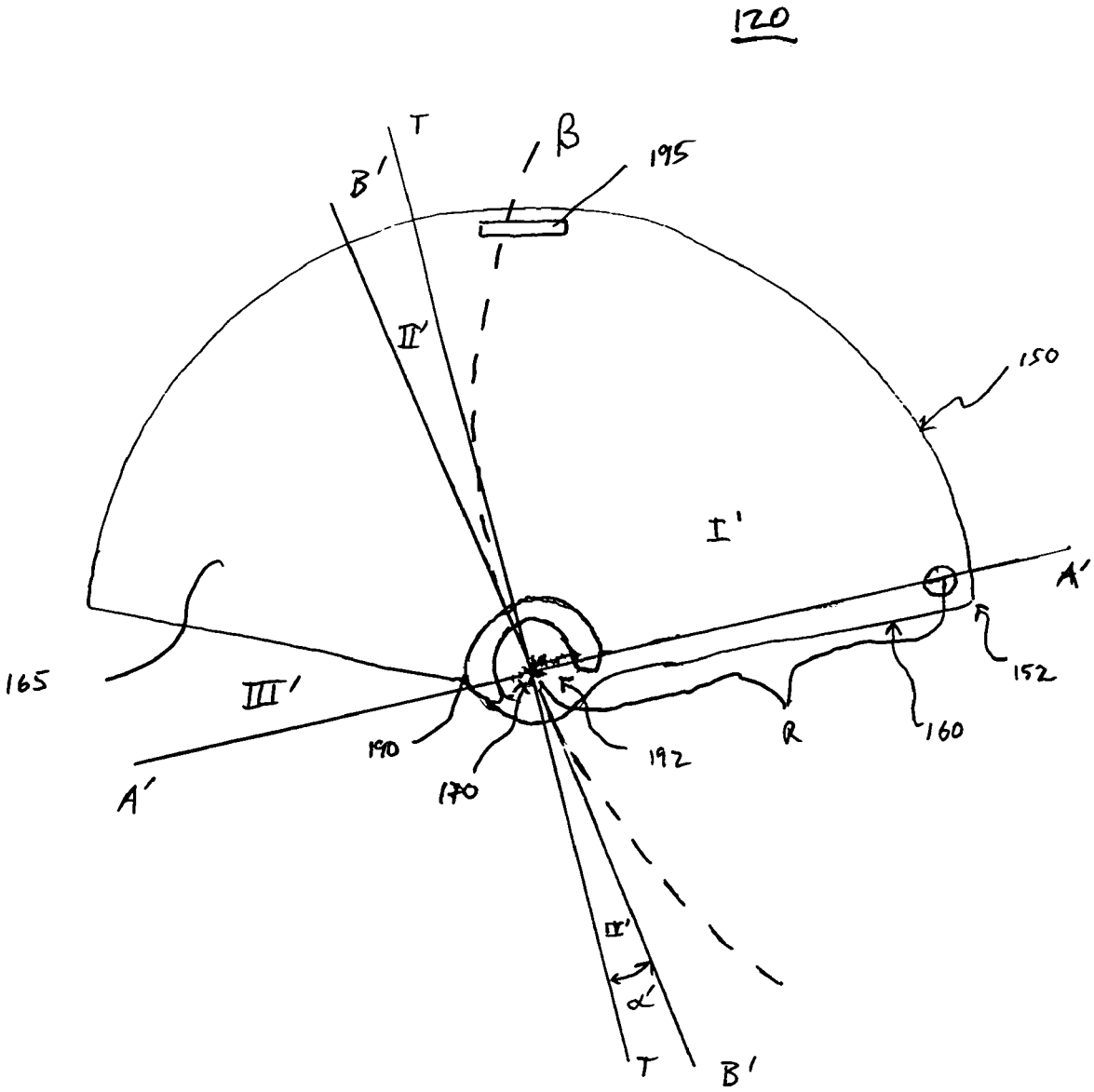
FIG. 6 is a side view of an exemplary pivoting half of a pizza cutter housing in accordance with various aspects of the present invention.

For example, as is illustrated in FIGS. 4–6, halves 120, 130 have a generally "clam-shell"-like shape. That is each half 120, 130 as viewed from its broadest side, is comprised of an arcuate outer gripping border 150 having opposing ends 152 which are joined by a generally linearly extending blade exposing border 160, providing the "clam-shell"-like shape. The clam-shell shape thus allows force from the user to be placed directly over the center of blade 200.

Of course, it should be apparent to one skilled in the art that each border 150, 160 may take any number of shapes. However, the inventors of the present invention have found the arcuate gripping border and linear blade exposing border to be the most ergonomically and aesthetically pleasing. In particular, in this non-limiting embodiment, border 150 is an arcuate segment of about 150 to 210 degrees, and preferably closer to about 160 to about 170 degrees. Further, in accordance with the presently described embodiment, linear blade exposing border 160 is suitably comprised of two lines extending radially from a point located near a center 170 of, as described further below, axle bearing surfaces 175 for supporting blade axle 210.

Figure 7:
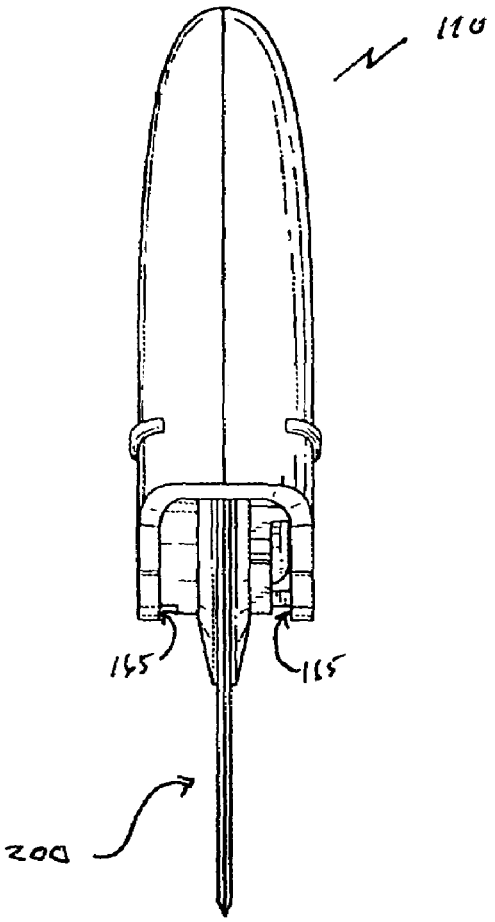
FIGS. 7 and 8 are side views of an exemplary pizza cutter in accordance with various aspects of the present invention.
Figure 8:
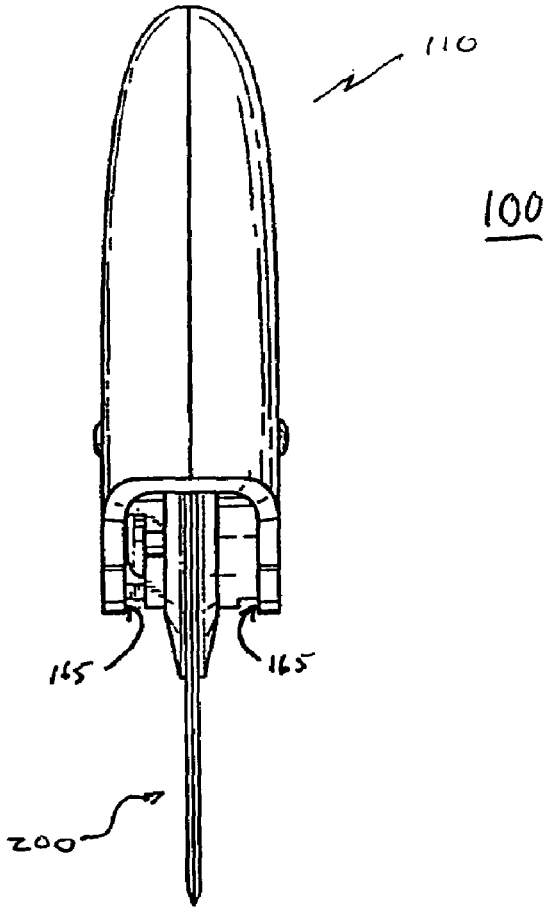

Further still, in the presently described embodiment, in furtherance of the clam-shell design, as well as in other configurations, halves 120, 130 are configured to accommodate blade 200 when closed. For example, each half 120, 130 are recessed such that when placed in a closed position, an outer shell is created having a hollow interior, into which blade 200 fits (see FIGS. 7–8, showing side views of the narrowest perspective of closed pizza cutter 100).

As mentioned above, in accordance with various embodiments of the present invention, halves 120, 130 are configured with bearing surfaces 175 for supporting blade 200. As noted above, blade axle 210 engages axle bearing surfaces 175 when housing 110 is closed such that blade 200 can rotate within housing 110. Additionally, in accordance with various embodiments of the present invention, halves 120, 130 further comprise segmented retainers 180, 190 which receive blade axle 210 and facilitate characteristics such as retention of blade 200 and/or stability of blade 200 within housing 110.

Figure 9:
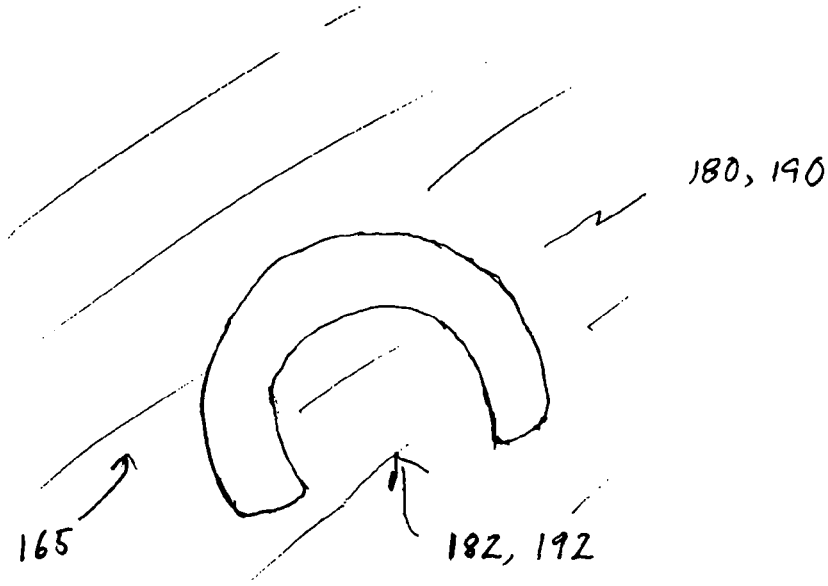
FIG. 9*a* is a top view of an exemplary segmented retainer in accordance with various aspects of the present invention.
FIG. 9*b* is a front side view from the opening of an exemplary segmented retainer in accordance with various aspects of the present invention.
Figure 9:
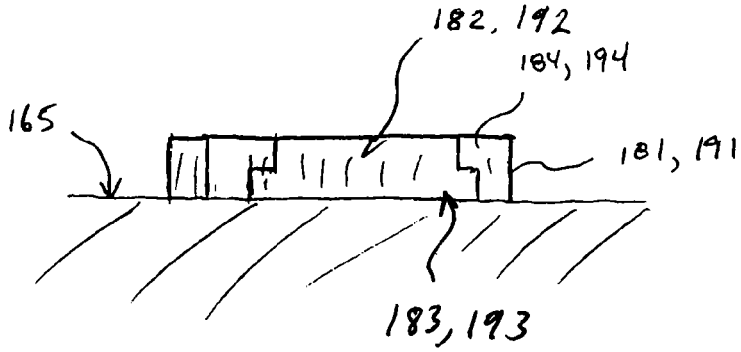
Figure 10:
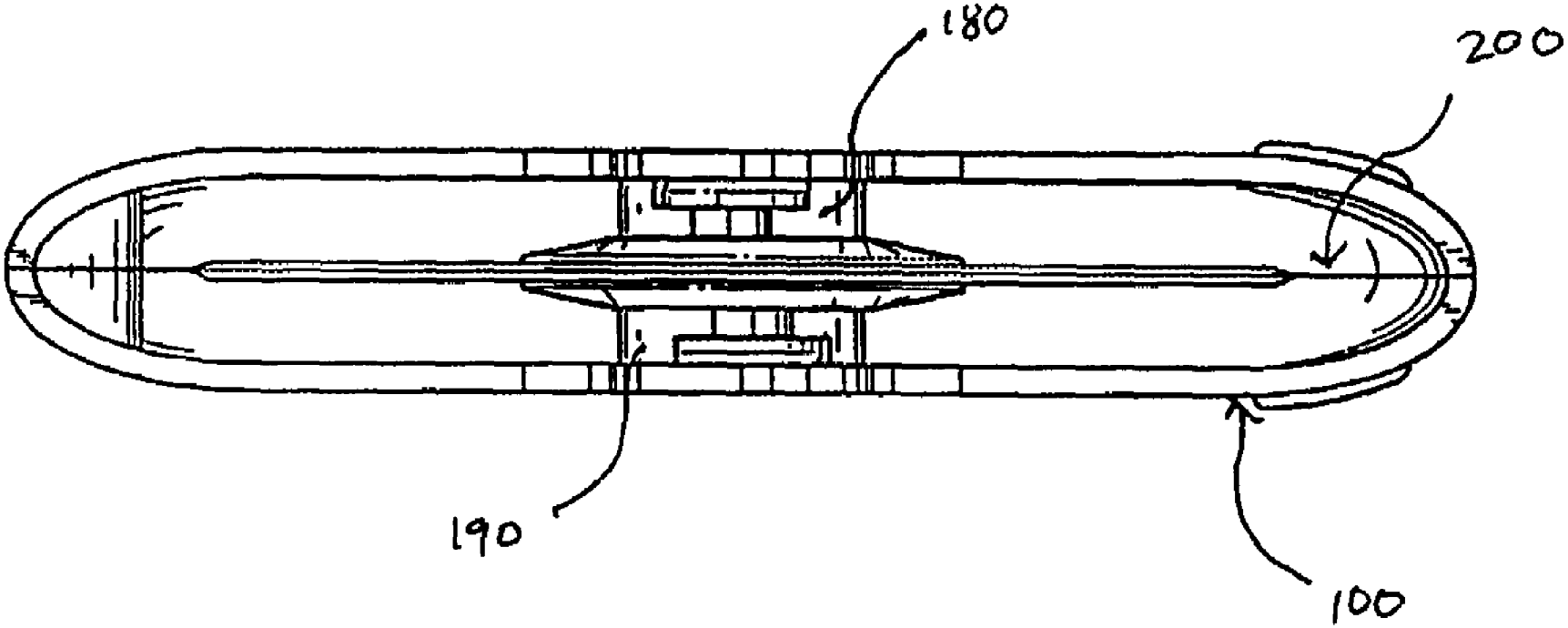
FIG. 10 is a bottom view of an exemplary pizza cutter in accordance with various aspects of the present invention.

In the presently described embodiment, each of segmented retainers 180, 190 is substantially similar in shape and size. Generally, with brief reference to FIG. 9, retainers comprise an arcuate wall 181, 191 extending from an inner surface 165 of each half 120, 130. Arcuate wall 181, 191 is preferably generally circular shaped, with an opening 182, 192 to a cavity 183, 193 having an inner diameter substantially equal to a diameter of axle lock 220 on blade 200, loose enough however, that blade 200 can rotate within housing 110. Segmented retainers 180, 190 further comprise a clasping wall 184, 194 having generally the same shape a arcuate wall 181, 191, having a similar positioned opening as wall 181, 191, but having a narrower internal diameter such that when blade axle 210 is inserted into retainer 180, 190, its removal is prevented by the interference between axle lock 220 and clasping wall 184, 194.

However, as noted above, while halves 120, 130 are generally mirror images of one another, halves 120, 130 may purposely include differences in some of their respective components to facilitate advantages of the present invention. For example, segmented retainers 180, 190, though having generally similar shapes on each half 120, 130, are suitably oriented at different angles on each respective half so as to facilitate removal and insertion of blade 200 when open, but maintain blade 200 as captive when closed. The same in accomplished in various exemplary embodiments by ensuring the segmented retainers 180, 190, have openings which are not coincident when housing 110 is closed.

For example, with reference to FIG. 5, half 130 represents an "insertion half" of housing 110 (the opposing half, a "pivoting half"). That is, in this exemplary embodiment, it is preferable that when housing 110 is open, blade axle 210 is inserted or removed from segmented retainer 180 found on this half 130. That is, while blade axle 210 is located within both of retainers 180, 190 when closed, as halves 120, 130 are opened, one end of axle blade leaves retainer 190, while remaining in retainer 180.

With continuing reference to FIG. 5, half 130 has a border axis A—A passing through center 170, and opening 182 has a central axis B—B, also passing through center 170. Border axis A—A and central axis B—B thus define four regions, I, II, III, and IV, between the axes. In accordance with the present invention, preferably, central axis B—B is as close to coincident with axis A—A as possible (angle $\alpha$ approaches zero) between, while still allowing blade 200 to be slidably removed from axle lock 220 without substantial interference from the remainder of housing 110/half 130. Stated otherwise, preferably the area of region IV is minimized.

Somewhat similarly, but with reference to FIG. 6, half 120 has a second border axis A'—A' passing through center 170, and a second central axis B'—B' through opening 192, also passing through center 170. Half 120 further comprises a tangent line T—T of a circle $\beta$ having a center defined by the pivot point of housing axle 140 (about which half 120 pivots with respect to half 130), circle $\beta$ having a radius (R) equal to the distance between the pivot point and center 170. Tangent T—T and axis B'—B' thus also define four regions, I', II', III', and IV'. However, with respect to segment 192, preferably, instead of axis B'—B' being as close as possible to coincident with axis A'—A', axis B'B' is as close to coincident with tangent T—T as possible (angle $\alpha'$ approaches zero). Stated otherwise, preferably the area of region IV' is minimized.

Figure 11:
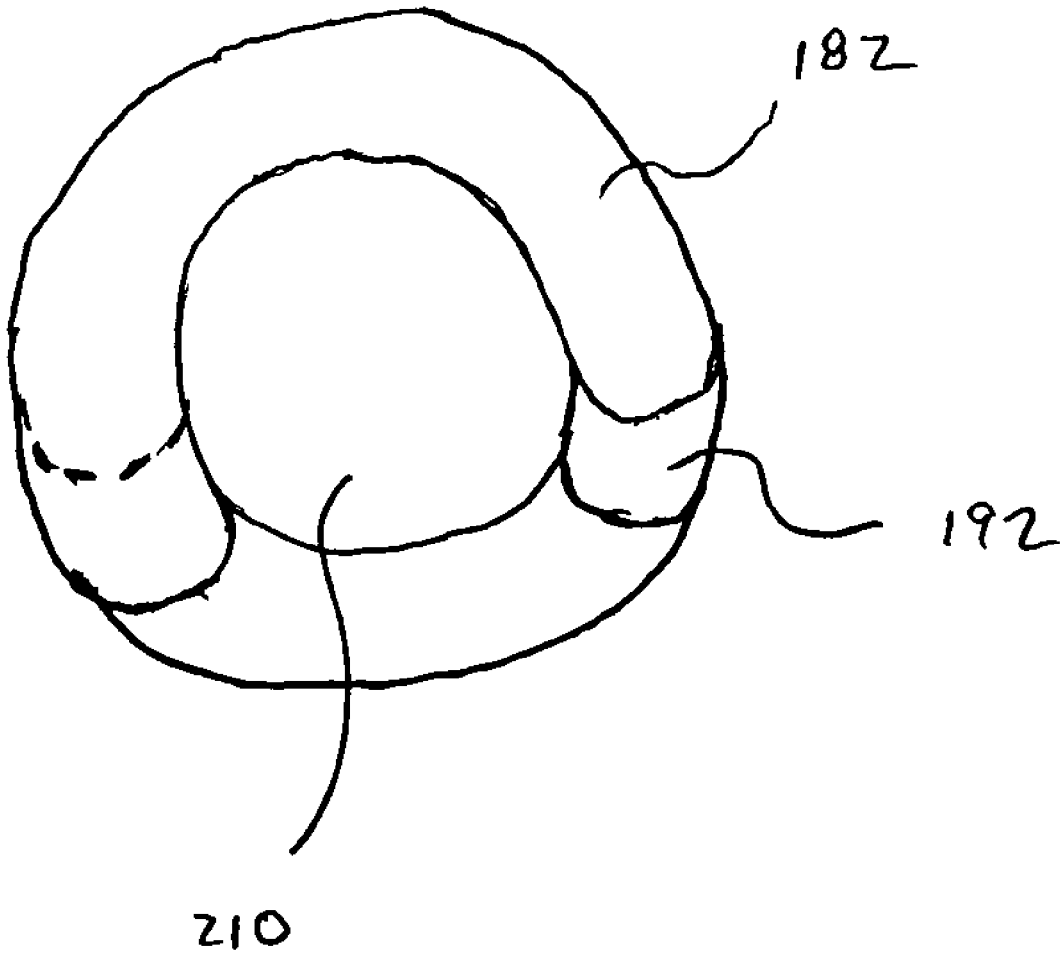
FIG. 11 is a view of segmented retainers in a closed pizza cutter in accordance with various aspects of the present invention.

Thus, when so configured, in the foregoing embodiment, when blade axle 210 is locked within axle locks 220 within closed housing 110, openings 182, 192 are thus oriented in different directions (see FIG. 11), and axle 210 is effectively retained within housing 110. Moreover, in accordance with further aspects of the present invention, as housing 110 is opened, as axle 210 remains in half 130, because opening 192 is oriented coincident with the tangent of a circle having a center as defined above and having a radius equal to the distance noted above, axle lock 220 slides through opening through the pivot of half 120, without interference.

Now, in accordance with still other aspects of the present invention, other features and aspects may likewise be included in pizza cutters 100 of the present invention. For example, housing 110 may have a housing halves locking mechanism suitable for maintaining halves 120, 130 as closed until opening is desired. For example, with reference to FIGS. 4—6, halves 120, 130 illustrate a locking mechanism 195 proximate to an upper portion of each half 120, 130. Locking mechanism suitably comprises any known or as yet unknown mechanism capable of keeping two halves of such designs shut, but exemplary devices include interference and snap-fit mechanisms. Examples include protruding lips and clasps flexible enough to engage when force is applied, but rigid enough to stay together until enough force is re-applied to open. Other mechanisms include projections and detents on opposing halves. It should also be understood that while the presently locking mechanism 195 is located proximate to an upper portion of housing 110, mechanism 195 may be located elsewhere on housing. Likewise, multiple locking mechanisms may be used depending on the amount of certainty housing 110 will remain closed. In any event, it should appreciated that many locking mechanisms and varying numbers of the same may be employed and still fall within the scope of the present invention.

Last, various principles of the invention have been described in illustrative embodiments. However, many combinations and modifications of the above-described structures, arrangements, proportions, elements, materials and components, used in the practice of the invention, in addition to those not specifically described, may be varied and particularly adapted to specific environments and operating requirements without departing from those principles.

We claim:

1. A rotating cutting device, comprising:

a handle and a blade, said blade comprising a rotably operable blade further comprising a blade axle having two ends;

said handle comprising a first half and a second half pivotally connected to one another, said first and second halves having an open position and a closed position, wherein said first half includes a first axle retainer having a first opening which receives one end of said blade axle and said second half includes a second axle retainer having a second opening which receives an opposite end of said blade axle, wherein said first and second axle retainers are configured with substantially coincident axle bearing surfaces and wherein said first and second openings in said first and second axle retainers are not coincident when said handle is in the closed position.

2. A rotating cutting device in accordance with claim 1, wherein said first and second halves comprise housings having substantially mirror images of one another, and wherein, in an axial plane, each housing further comprises an outer gripping border having opposing ends which are joined by a blade exposing border, and in a radial plane define a recess which accommodates said blade.

3. A rotating cutting device in accordance with claim 2, wherein said first and second halves are pivotally connected by a pivot located proximate to a corner defined by an intersection point between said gripping border and said blade exposing border.

4. A rotating cutting device in accordance with claim 2, wherein said outer gripping border comprising an arc segment.

5. A rotating cutting device in accordance with claim 4, wherein said arc segment is about 150 to about 210 degrees.

6. A rotating cutting device in accordance with claim 5, wherein said arc segment is about 165 degrees.

7. A rotating cutting device in accordance with claim 1, further comprising a housing halves locking mechanism.

8. A rotating cutting device in accordance with claim 7, wherein said housing halves locking mechanism further comprises a clasp on one of said first and second halves.

9. A rotating cutting device in accordance with claim 7, wherein said housing halves locking mechanism further comprises a projection on one of said first and second halves and a detent on the other of said first and second halves.

10. A rotating cutting device in accordance with claim 1, wherein said blade has a removal facilitator.

11. A rotating cutting device in accordance with claim 1, wherein said first half further comprises a border axis A—A passing through a center of said first axle bearing surface, wherein said first axle bearing surface further comprises a first segmented retainer, said first segmented retainer having a first opening for receipt of one end of said blade axle, said first opening having a central axis B—B, and wherein an angle $\alpha$ between said border axis A—A and said central axis B—B is about zero degrees.

12. A rotating cutting device in accordance with claim 11, wherein said second half further comprises a tangent axis T—T passing through a center of said second axle bearing surface, wherein said second axle bearing surface further comprises a second segmented retainer, said second segmented retainer having a second opening for receipt of an opposing end of said blade axle, said second opening having a second central axis B'—B' and wherein, an angle $\alpha'$ between said central axis B'—B' and said tangent line T—T is about zero degrees.

13. A rotating cutting device, comprising:

a handle and a blade, said blade comprising a rotably operable blade further comprising a blade axle having a first end and a second end;

said handle comprising a first half and a second half moveable about a pivot between an open position and a closed position, wherein said first half includes a first axle retainer having a first opening configured to receive said first end of said blade axle and said second half includes a second axle retainer having a second opening configured to receive said second end of said axle when said first and second halves are moved from said open position to said closed position, and wherein said first and second openings in said first and second axle retainers are not coincident when said handle is in said closed position.

14. The device of claim 13, wherein at least one of said first and second ends of said axle comprise an axle lock of a diameter greater than said respective axle end and wherein said respective axle retainer is configured to retain said respective axle end through interference with at least one of said axle lock and said respective axle end.

15. The device of claim 13, wherein said blade comprises an opening to facilitate grasping of said blade by a user to overcome an interference fit to remove said first axle end from said first opening of said first axle retainer when said handle is in said open position.

16. The device of claim 15, wherein said interference fit is between said first axle retainer and an axle lock formed at said first end of said axle.

17. The device of claim 13, wherein said second axle retainer is configured to release said second axle end during movement of one of said first and second halves from said closed position to said open position, and wherein said first axle retainer is configured to removably retain said first axle end through an interference fit.

18. The device of claim 13, wherein said second axle retainer is aligned with an arc centered about said pivot.

19. The device of claim 13, wherein said first and second axle ends comprise respective first and second axle lock portions having a diameter greater than the rest of said axle and wherein said first and second axle retainers are configured to retain said respective axle lock portions so as to prevent axial movement of said axle.

* * * * *